US006464526B1

(12) United States Patent
Seufert et al.

(10) Patent No.: US 6,464,526 B1
(45) Date of Patent: Oct. 15, 2002

(54) ELECTRIC PLUG AND SOCKET ASSEMBLY

(75) Inventors: Ralf Seufert, Zeil; Stefan Tluczykont, Rattelsdorf, both of (DE)

(73) Assignee: Wieland Electric GmbH, Bamberg (DE)

( * ) Notice: Subject to any disclaimer, the term of this patent is extended or adjusted under 35 U.S.C. 154(b) by 0 days.

(21) Appl. No.: 09/508,332

(22) PCT Filed: Sep. 4, 1998

(86) PCT No.: PCT/EP98/05614

§ 371 (c)(1),
(2), (4) Date: Jun. 19, 2000

(87) PCT Pub. No.: WO99/13536

PCT Pub. Date: Mar. 18, 1999

(30) Foreign Application Priority Data

Sep. 10, 1997 (DE) ..... 197 39 576

(51) Int. Cl.[7] ..... H01R 13/627
(52) U.S. Cl. ..... 439/352; 439/358
(58) Field of Search ..... 439/352, 372, 439/345, 350, 567, 571, 572, 357, 358

(56) References Cited

U.S. PATENT DOCUMENTS

| | | | | |
|---|---|---|---|---|
| 4,017,139 A | | 4/1977 | Nelson | |
| 4,545,633 A | | 10/1985 | McGeary | |
| 4,880,393 A | | 11/1989 | Moji | |
| 5,316,494 A | | 5/1994 | Flanagan et al. | |
| 5,350,312 A | | 9/1994 | Kuno et al. | |
| 5,595,499 A | | 1/1997 | Zander et al. | |
| 5,637,010 A | | 6/1997 | Jost et al. | |
| 5,827,089 A | * | 10/1998 | Beck, Jr. | 439/567 |

FOREIGN PATENT DOCUMENTS

| | | |
|---|---|---|
| DE | 41 00 649 | 7/1992 |
| DE | 43 25 895 | 12/1994 |
| FR | 2 669 897 | 6/1992 |
| SE | 398 689 | 1/1978 |

* cited by examiner

*Primary Examiner*—Tho D. Ta
*Assistant Examiner*—Edwin A. León
(74) *Attorney, Agent, or Firm*—Venable; Robert Kinberg

(57) ABSTRACT

In order to reliably lock an electric plug and socket assembly (1) including an outer part (2) and inner part (3) which can be coupled to the outer part, the inner part is provided with a recess (17,17') into which, when the two parts are coupled, a snap-on hook means (14,14') is engaged and maintained so as to act as a spring. When the plug and socket assembly (1) is in a locked position, the snap-on hook means (14) or each snap-on hook means is locked against radial excursion since it rests on a bushing (7) which is axially displaceable on the outer part (2). In the locked position, the backward pulled bush (7) releases the snap-on hook means (14,14') thereby allowing for disengagement of the outer and inner parts (2,3). In order to enable the plugging of the parts (2,3) when the bushing (7) is in the locked position, the snap-on hook means (14') is provided with two spring legs **(14*c*) whose end cam (14'*a*) and an inner contour (41) running into the recess (17') of the inner part (3) form a guide for the two leg snap-on hook means (14')**.

20 Claims, 9 Drawing Sheets

ELECTRIC PLUG AND SOCKET ASSEMBLY

Figure 1:
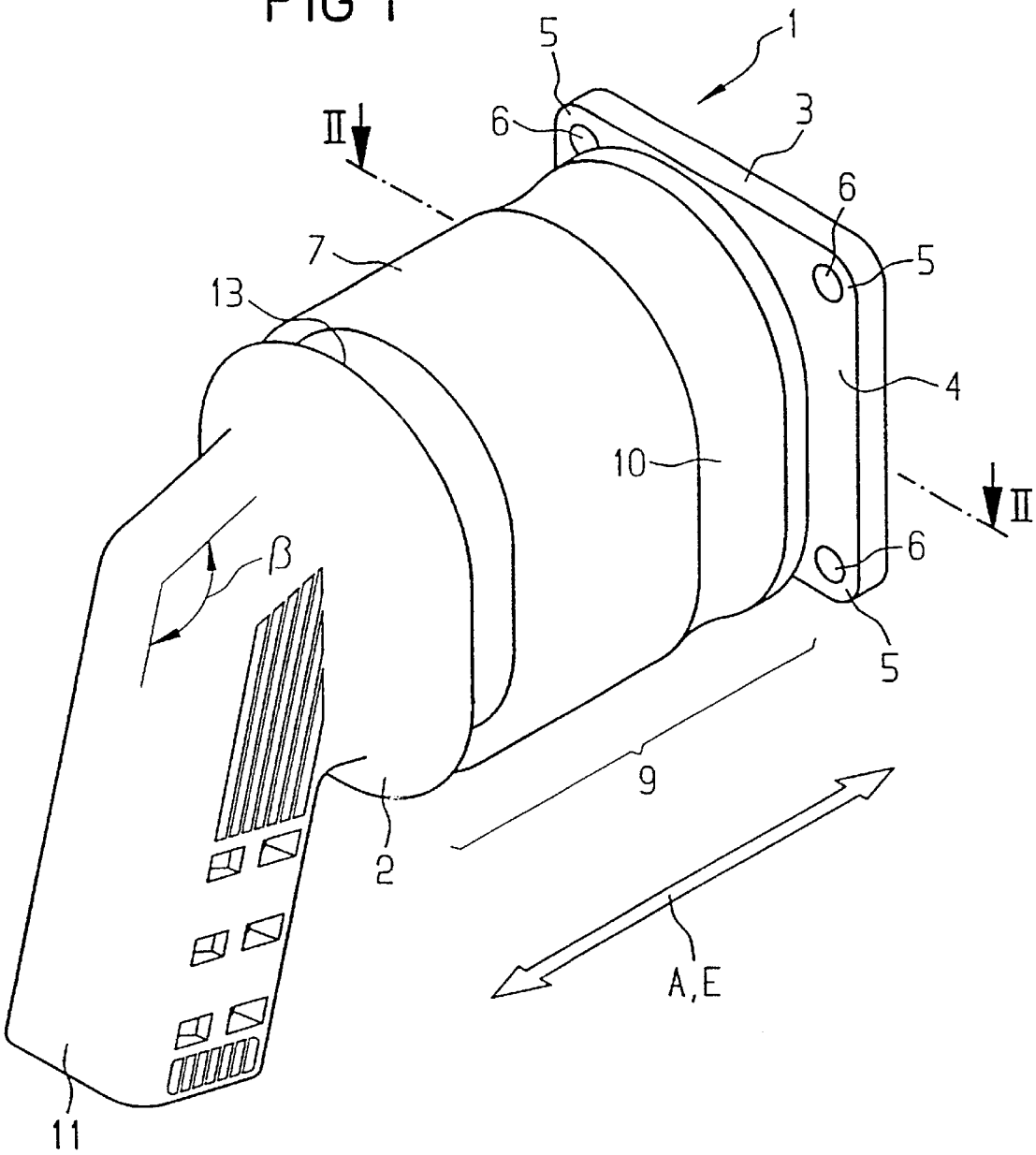

The invention relates to an electrical plug and socket assembly as defined in the preamble to claim 1. In this case, electrical plug and socket assembly particularly refers to an electrical line connection or an electrical device connection having a coupler connector and a portable socket-outlet.

A plug and socket device of this type, which is known, for example, from U.S. Pat. No. 5,637,010, serves the purpose of producing an electrical plug-in connection. To this end, a detachable electrical connection to a counter-contact part is produced by a plug contact part, for example in the form of a multi-pole coupler connector, that is connected to an electrical line. The counter-contact part, e.g., in the form of a portable socket-outlet, can also be connected to an electrical line, or directly to an electrical device.

To prevent contact between voltage-conducting parts, a plug and socket device of this type is frequently provided with a protective collar that projects beyond the voltage-conducting parts, and typically comprises an insulating material. The plug and socket device essentially includes an outside part, advantageously in the form of the plug part, and an inside part, which is received by the outside part and contains the counter-contacts of the plug and socket assembly in the form of sockets. The dimensions of the inside and outside parts are usually matched to one another such that the plug and socket assembly is held together by a non-positive lockup or a form-fit. To this end, the inside part that can be coupled to the outside part has a recess, into which a barb extends in the coupled state, the barb being held resiliently in a hole in the outside part, and secured against a radial deflection by its contact with a sleeve disposed to be axially displaced on the outside part.

In a plug and socket assembly known from U.S. Pat. No. 4,017,139, the axially-displaceable sleeve serves, on the one hand, to guard against an accidental loosening of the plug and socket assembly, and, on the other hand, to prevent an accidental coupling of the plug parts. From a resting or normal position, the sleeve can be displaced past this resting position, in and counter to the plug-in direction, up to a respective unlocking stop, so practically three stops are provided for the sleeve. This stipulates a complex, and therefore costly, locking mechanism, however.

It is therefore the object of the invention to disclose a locking mechanism for an electrical plug and socket assembly of the type mentioned at the outset, the mechanism being particularly reliable and having a comparatively simple design. The mechanism prevents an accidental separation of the two coupling parts, on the one hand, and permits a detachment of the plug and socket assembly that can be repeated as often as desired, on the other hand.

In accordance with the invention, this object is accomplished by the features of claim 1. Because the outside part has only two stops for the sleeve in the locked position and the unlocked position, the sleeve's path of displacement on the shaft of the outside part is limited. In addition to the step on the shaft of the outside part, which forms the unlocked stop, at its end facing the insertion opening, the sleeve is provided with webs that are oriented inward and distributed over the inside circumference, and, in the locked position, rest against a retaining collar formed onto the outside part in the region of the insertion opening.

A plurality of resilient barbs, preferably two barbs located opposite one another, are preferably provided on the outside part of the plug and socket assembly, while the inside part has corresponding recesses for receiving the barbs. For the locking process, the barbs are blocked against a radial deflection by a sleeve that surrounds the outside part coaxially and is displaceable, being carried by the outside part. Unlocking is effected by the displacement of the sleeve counter to the plug-in or insertion direction. This releases the barbs, so they can move radially outward when the plug and socket assembly is decoupled.

A restoring spring is provided for maintaining the locking in the normal position, which is simply and advantageously achieved by the contact of the barbs with the inside wall of the sleeve. The spring is advantageously inserted into a closed, annular space between the outside part and the sleeve, which is advantageously limited by a web on the inside wall of the sleeve, and a step on the shaft of the outside part. To unlock the plug and socket assembly, the sleeve is displaced counter to the spring force, so the sleeve is always forced back into the normal, or locked, position.

The barb, or every barb, is advantageously formed from a cam and a resilient shaft (spring shaft) that are formed in one piece and disposed one behind the other in the axial direction, the shaft being molded in a hole in the outside part. The barb embodied in the manner of a cast-on spring tongue is thus self-resilient, and, in the normal position, is aligned with the wall that borders the insertion opening for the inside part. As an alternative, the barb can be deflected outward in the resting or normal position when the sleeve is retracted, and is thus prestressed when the barb is pressed in the direction of the interior chamber formed by the protective collar of the outside part when the sleeve is pushed forward, and the sleeve again fixes the barb against outward movement. This alternative simplifies the separation of the two plug connection or coupling parts.

The entrance inclination a of the barb can be less than the exit inclination. The entrance inclination should only deviate from a 0° inclination by an amount that assures the joining of the inside and outside parts when the sleeve is in the unlocked position. The angle of inclination $\alpha$ is preferably between zero and 45 degrees.

Because the barb or locking hook has a two-legged spring shaft whose two spring legs, which support a cam or latch at the end, extend transversely to the radial direction of cam deflection, the locking mechanism operates in the manner of a directional locking mechanism. The spring legs lie in the plane of the hole in the outside part in which the barb is formed, the plane extending parallel to the insertion or joining direction. For guiding the cams or latches, the inside part has an inside contour that terminates in the recess. The inside contour tapers in the insertion direction toward the recess. This locking mechanism permits the outside part to be pushed onto the inside part without the sleeve being retracted into the unlocked position.

In contrast to a conventional snap connection of a directional locking mechanism described in terms of design and function in, for example, "Bauelemente der Feinmechanik [Precision Mechanics Components]," O. Richter, R. v. Voss, F. Kozer, VEB Verlag Technik [Publisher] Berlin, $9^{th}$ Edition (1964), pp. 283 et seq., the cams or barbs do not lie in the plane of the push guidance of the spring legs. Instead, the cams are advantageously directed radially inward toward the receptacle chamb er for the inside part by 90° from the plane of the push guidance, so the inside contour only forms one track guide with the cams. The spring legs themselves are not guided at the inside contour. For locking, the cams or latches therefore do not lock in cams or locking bars located next to the spring legs, but in the radially inward-oriented recess in the inside part. The locking mechanism thus permits the inside and outside parts to be coupled when the sleeve is in the locked position, which then reliably prevents a release of the plug and socket assembly. Furthermore, when the sleeve is retracted, the plug and socket assembly is unlocked in that the barbs can yield radially outward, thereby unlatching the cams, which are embodied as pull latches, from the counter-surface of the latching region.

The insertion end of the inside part supports a sealing ring for sealing the plug and socket assembly. To prevent the sealing ring from creating an obstruction when the two coupling parts are coupled, the inside part has at least two diameter steps, which decrease toward the insertion end; the step facing the insertion end is provided with a circumferential groove for receiving the sealing ring. The inside diameters of the outside part are adapated to these steps, assuring a reliable sealing effect after the plug and socket connection is produced.

The inside part has a plurality of axially-extending, throughgoing openings for receiving contact inserts, while throughgoing openings that are aligned with the axial openings are provided in the housing floor of the outside part in order to receive the counter-contact inserts. The outside part is advantageously embodied as a plug, while the inside part forms the socket. The reverse embodiment is also feasible, however. In this case, the jacket of the outside part, which limits the insertion opening, simultaneously forms the protective collar for preventing the plug contacts from bending due to external mechanical influences.

On the side of the jacket, the sleeve is provided with a circumferential recessed grip, which facilitates the manual displacement of the sleeve. To further facilitate the handling of the plug and socket assembly, a handle part is molded onto the end of the outside part located opposite the insertion opening, the part making a transition in one piece into a guide sleeve that is preferably bent at an oblique angle for receiving an electrical line.

Figure 2:
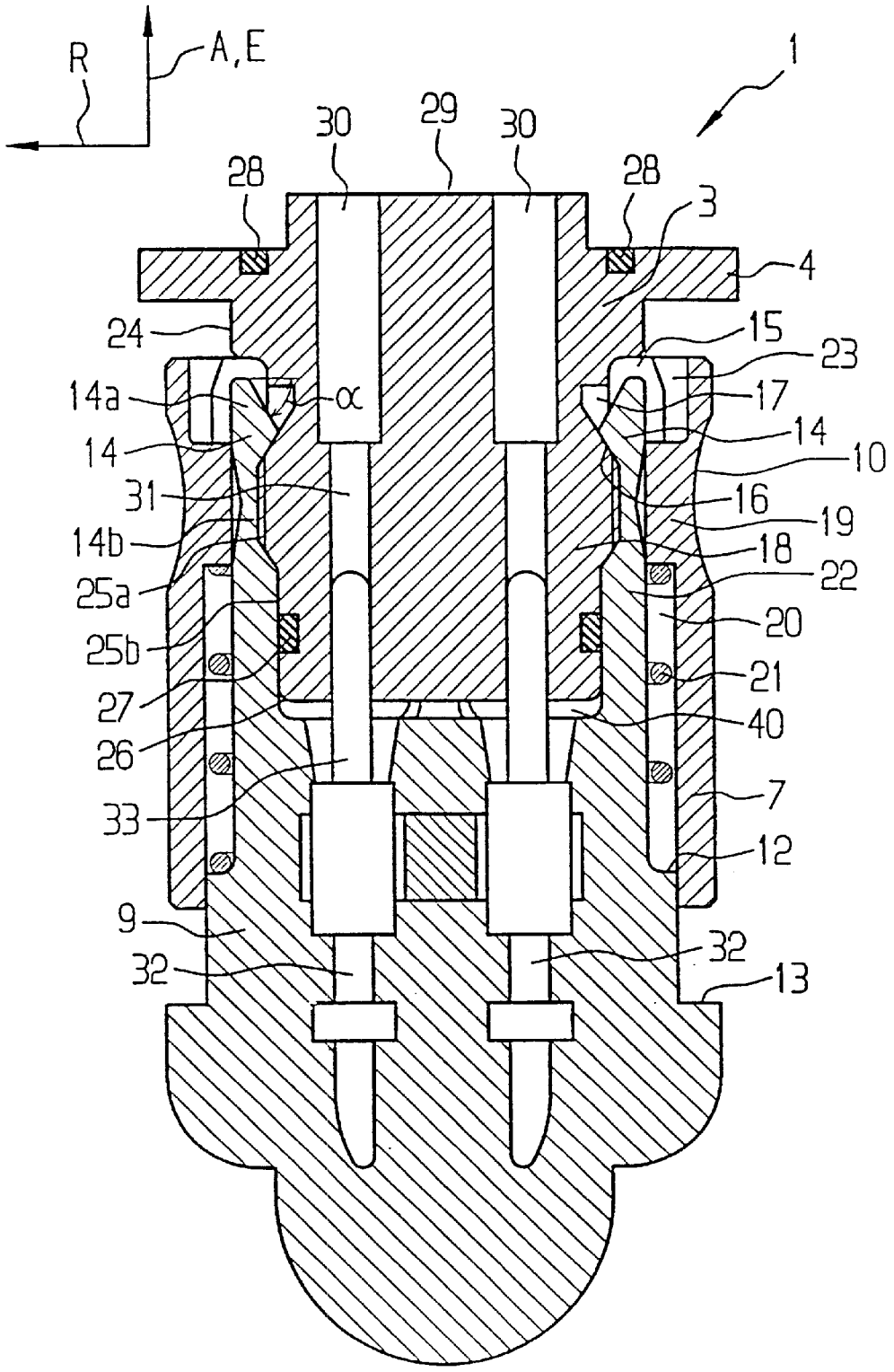
Figure 3:
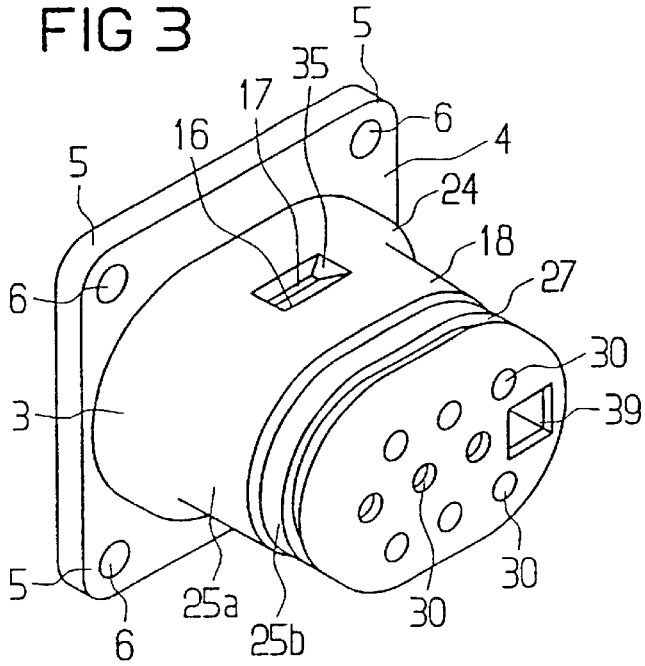
Figure 4:
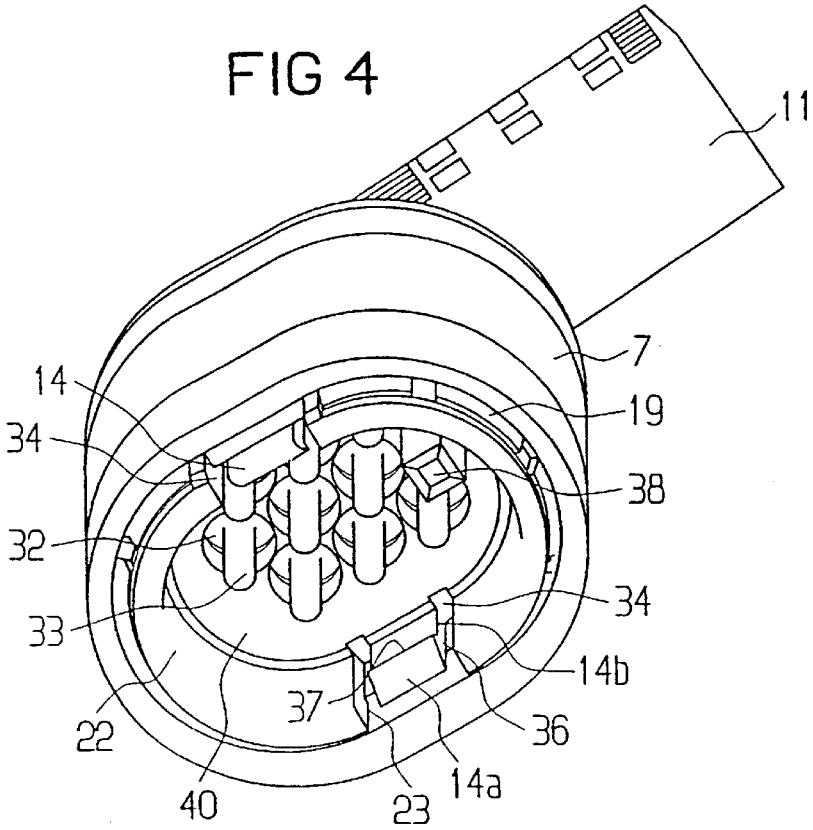
Figure 5:
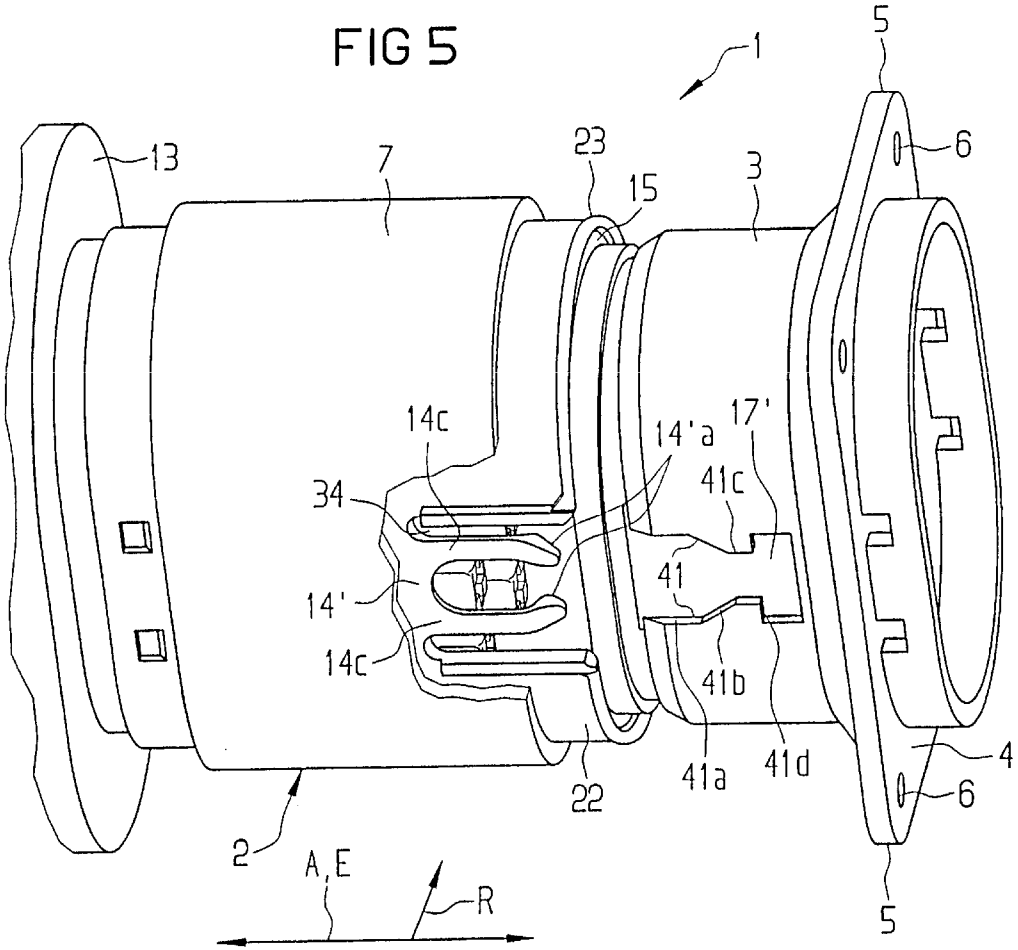
Figure 6A:
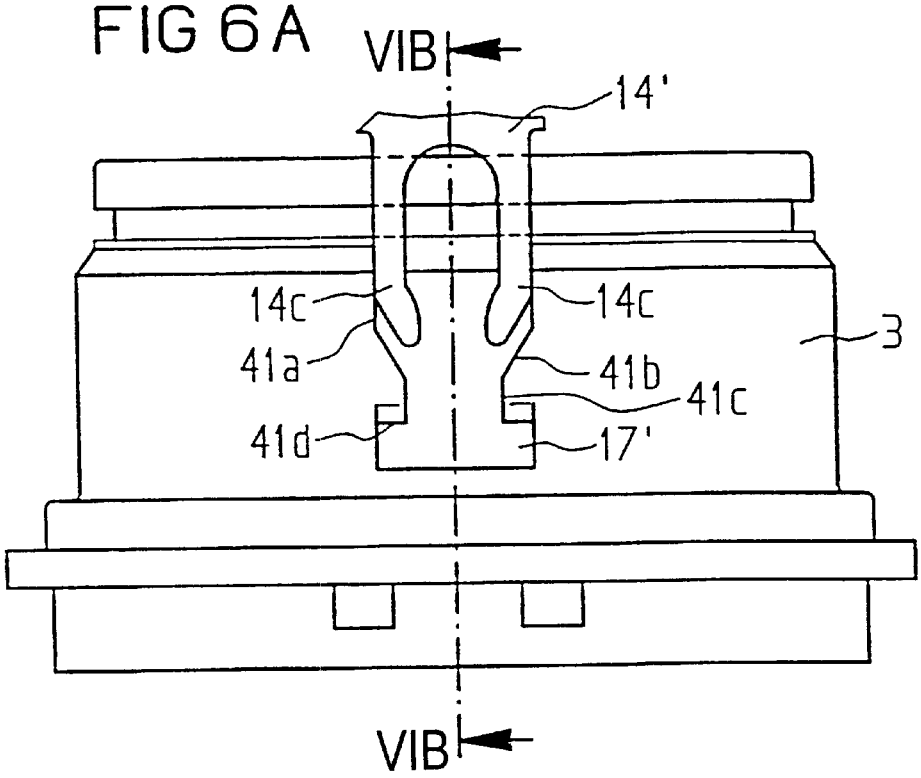
Figure 6B:
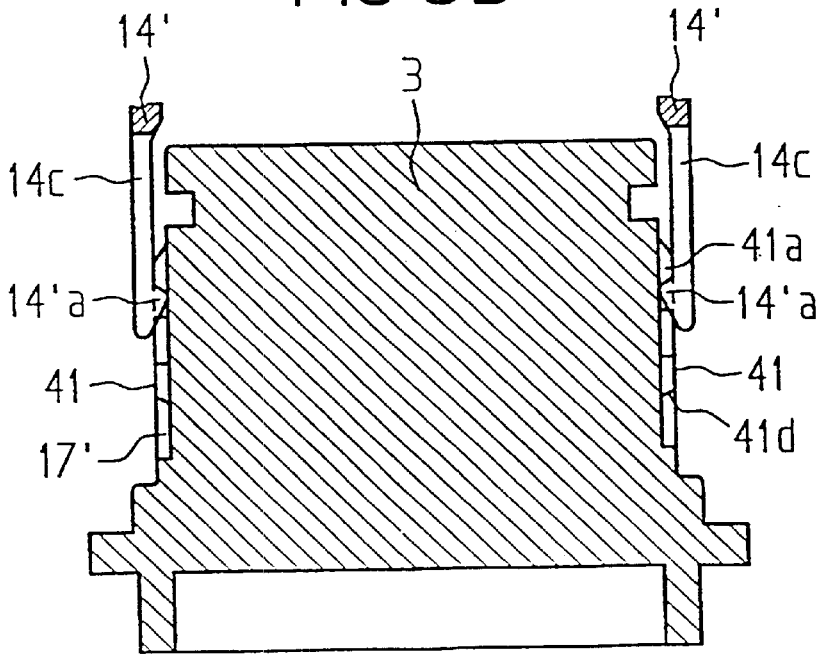
Figure 7A:
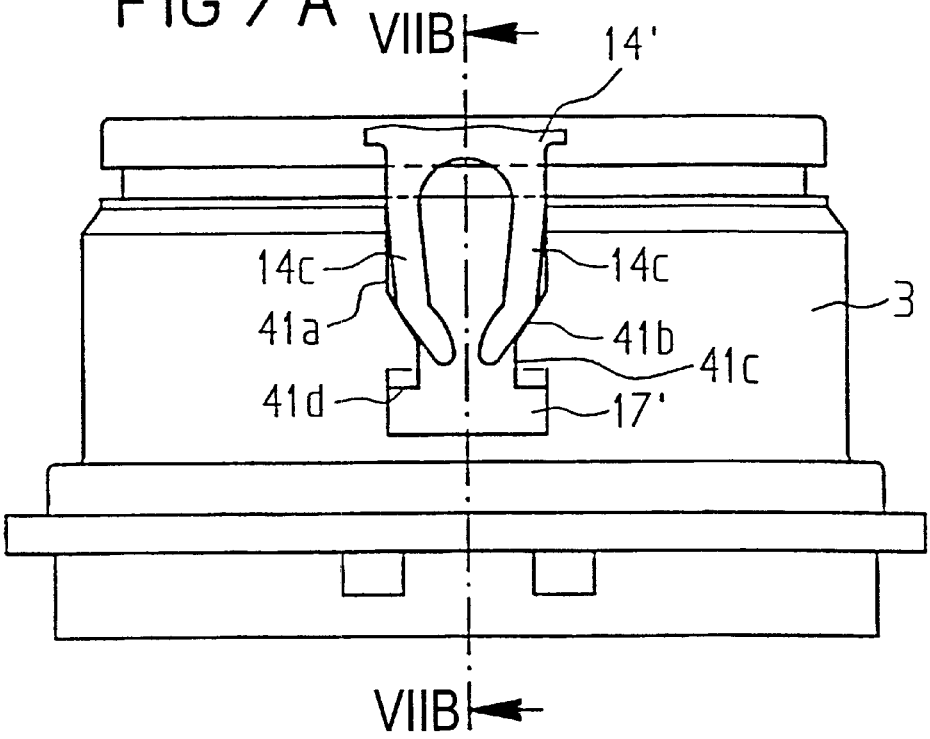
Figure 7B:
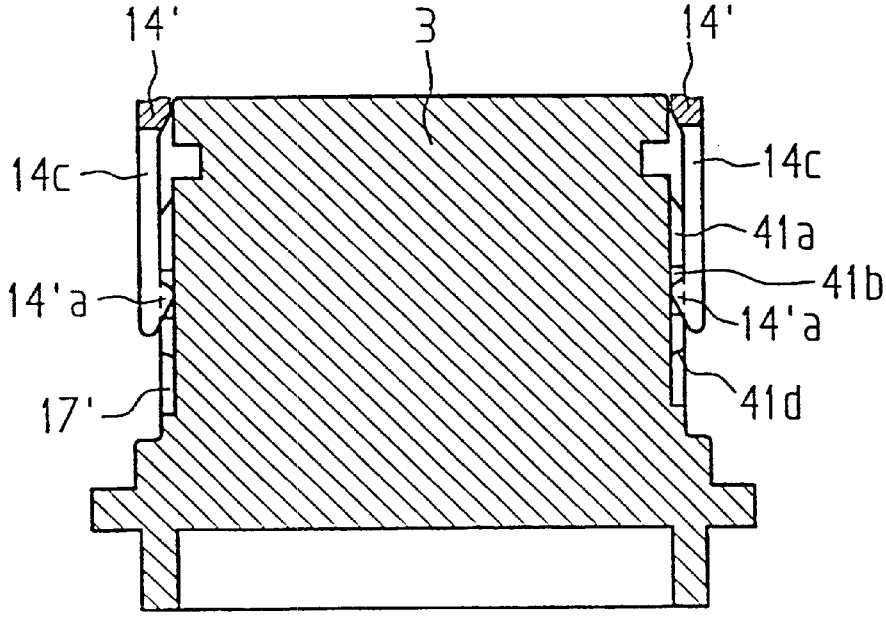
Figure 8A:
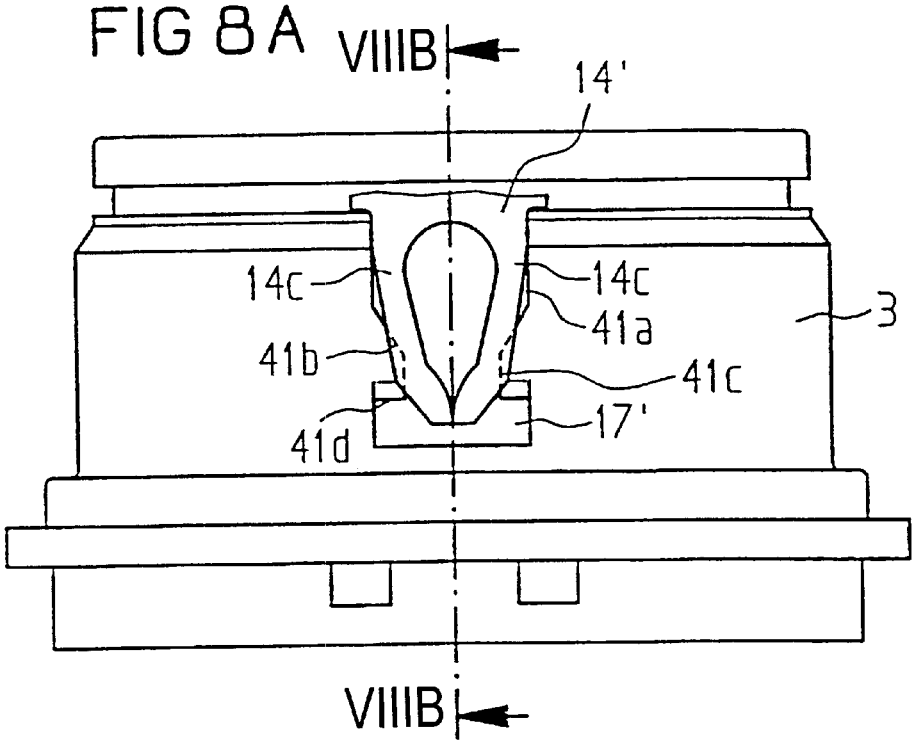
Figure 8B:
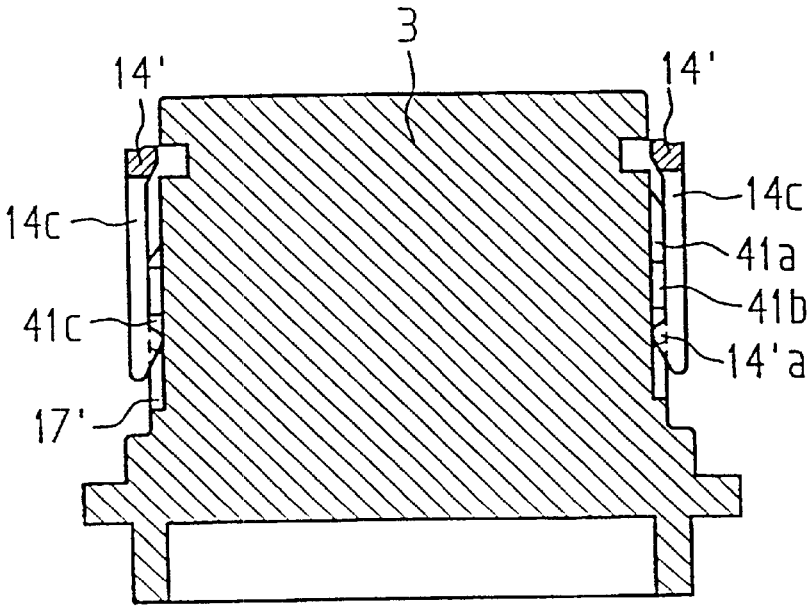
Figure 9A:
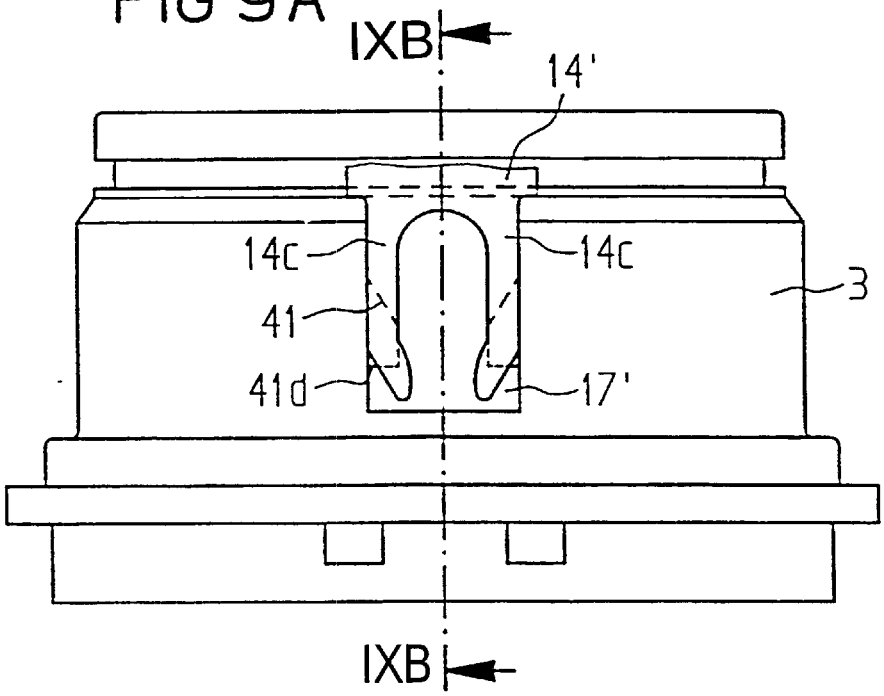
Figure 9B:
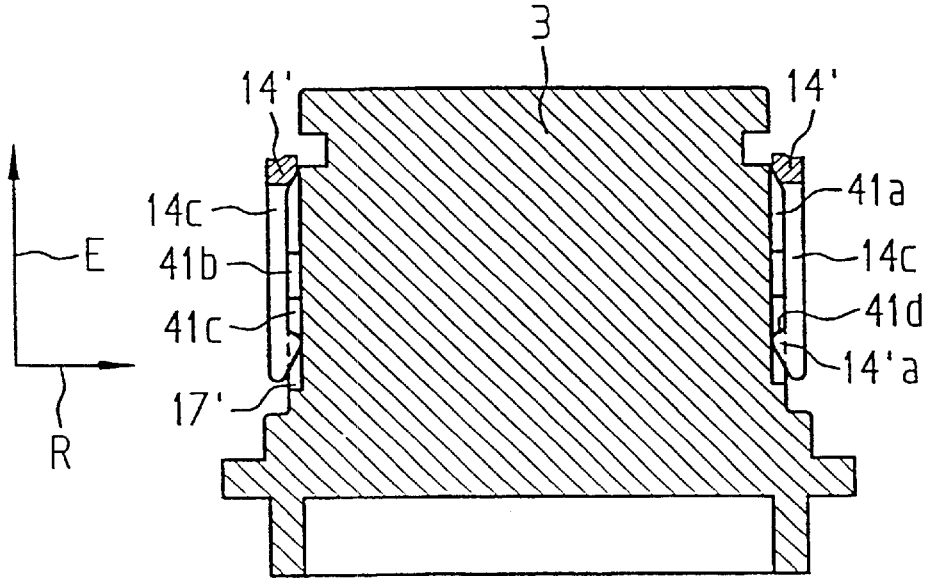
Figure 10A:
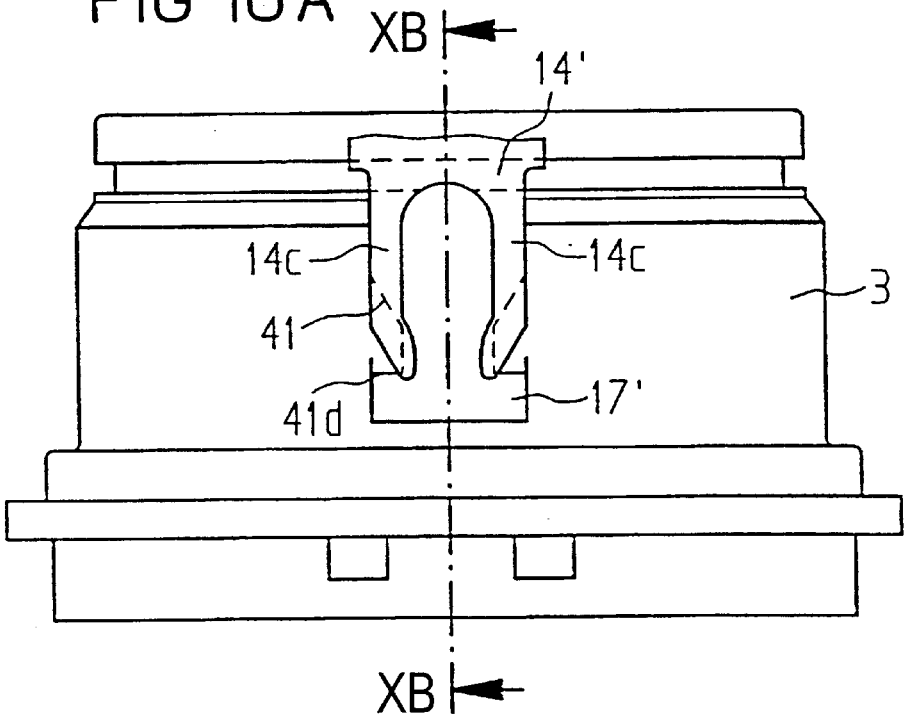
Figure 10B:
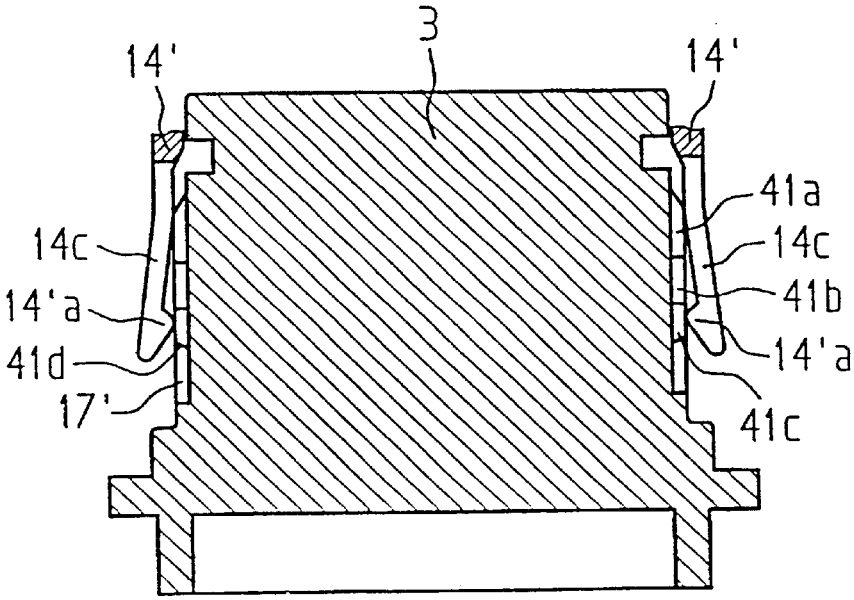

Embodiments of the invention are described in detail below in conjunction with a drawing. Shown are in:

FIG. 1 a perspective representation of an electrical plug and socket assembly according to the invention, with an inside part inserted into an outside part;

FIG. 2 the plug and socket device according to FIG. 1, in a longitudinal section II—II;

FIGS. 3 & 4 a perspective representation of the inside and outside part, respectively, of the decoupled plug and socket device, in a first variation;

FIG. 5 a perspective representation of a further variation of the plug and socket device, in which the outside part is guided toward the inside part and the sleeve is partially retracted and shown in a cut-away view in the region of a two-legged barb;

FIGS. 6*a* & 6*b* the two-legged barb in an entry region of a track guide on the inside part of the plug and socket device according to FIG. 5, in a side view and a cross-section VIB—VIB, respectively;

FIGS. 7*a* & 7*b* the two-legged barb in a tapered region of the track guide according to FIG. 6, in a side view and a cross-section VIIB—VIIB, respectively;

FIGS. 8*a* & 8*b* the two-legged barb at the narrowest point of the track guide, in a side view and a cross-section VIIIB—VIIIB, respectively;

FIGS. 9*a* & 9*b* the two-legged barb in-the latched state, in a side view and a cross-section IXB—IXB, respectively; and FIGS. 10*a* & 10*b* the two-legged barb in the unlocked state, with unlatched spring legs, in a side view and a cross-section XB—XB, respectively.

Corresponding parts are provided with the same reference characters in all figures.

FIG. 1 shows the electrical plug and socket device 1 as a device plug and socket assembly, in the coupled and locked state. It includes an outside part 2 and an inside part 3, which is inserted into or pushed onto the outside part 2. The inside part 3 surrounds a retaining plate 4 with rounded corners 5, the plate being quadratic in the illustrated embodiment and having holes 6 for fastening means (not shown) in the region of the corners. The retaining plate 4 can be used to secure the inside part 3 to, for example, an electrical device. The outside part 2 supports a sleeve 7, which can be displaced in the axial direction A along a shaft 9 of the outside part 2, in and counter to the insertion direction E coinciding with the axial direction A. For better handling, the sleeve 7 is provided at its end facing the inside part 3 with a recessed grip 10 that extends at the circumference of the jacket.

The outside part 2 is embodied in the manner of an angle entry plug and, at its end remote from the inside part 3, has a guide sleeve 11 that is bent at an oblique angle β ($\beta \geqq 90$ °) and serves as a guide for a connecting line (not shown). The guide sleeve 7 is advantageously formed onto the outside part 2. It can, however, also be embodied as a separate, exchangeable part. In the extension of this molded handle in the insertion direction E, the outside part is stepped on the jacket side to form a step 13, which constitutes an unlocking stop for the sleeve 7 when the sleeve is displaced counter to the insertion direction E. A retaining collar can also be formed onto the outside part 2 instead of such a step 13.

The sleeve 7 is a component of a locking and unlocking mechanism of the plug and socket assembly 1, as can be seen in the sectional representation according to FIG. 2. In the illustrated locked state, the sleeve 7 blocks two diametrically-opposite barbs 14, which are components of the outside part 2 and the locking mechanism. The barbs 14 extend in the insertion direction E up to the termination point of an insertion opening 15 of the outside part 2. There, they latch behind an withdrawal inclination 16 of a recess 17 in the shaft 18 of the inside part 3. The locking is effected by the contact of the barbs 14 with the inside wall of the sleeve 7 in the illustrated normal position of the barbs. This prevents a deflection of the barbs 14 in the radial direction R.

The contact surface is advantageously formed by an inward-oriented collar or web contour 19 at the inside wall of the sleeve 7 in the region of the recessed grip 10. This web contour 19 and a step 12 at the outside part 2 limit an annular chamber 20 formed between the sleeve 7 and the outside part 2, whose expansion in the axial direction A is reduced by the displacement of the sleeve 7 counter to the insertion direction E. This annular chamber 20 serves to receive a restoring spring 21, which always forces the sleeve 7 into the locked position. The reduction of the annular chamber 20 by the displacement of the sleeve 7 counter to the insertion direction E thus effects a prestressing of the restoring spring 21 embodied as a compression spring. The spring 21, which is supported by the outside part 2, is therefore invisible and cannot be lost.

The barbs 14 are advantageously embodied in the form of cast-on spring tongues, and are therefore self-resilient. Each barb 14 has a cam 14a and a resilient shaft (spring shaft) 14*b* that are formed in one piece and disposed one behind the other in the axial direction A. At the end of the spring shaft 14*b* of the barb 14 that is remote from the cam 14*a*, the shaft is connected in one piece to the jacket wall 22 of the outside part 2 that limits the insertion opening 15. The jacket wall 22 simultaneously forms a protective collar for preventing a mechanical contact stress through external forces. At the insertion opening 15, the jacket wall 22 is directed outward in the form of jacket webs 23 in the manner of a collar, so the jacket webs 23 form a locking stop for the sleeve 7.

The insertion inclination a of each barb 14 is about 45° in the illustrated embodiment, and therefore approximately corresponds to the withdrawal inclination 16. The insertion inclination α of the barb 14, however, is nearly zero degrees, and is thus smaller than the withdrawal inclination 16. This prevents the outside part 2 and the inside part 3 from being coupled when the sleeve 7 is in the locked position. The locking mechanism with the barbs 14 and the sleeve 7, on the one hand, and the recesses 17, on the other hand, thus represents a locking mechanism both with respect to the joining and separation of the plug and socket device 1. In this variation of the plug and socket device 1, an accidental or unauthorized production or release of the plug and socket connection is reliably prevented.

The inside part 3 has a stepped outside contour with three different diameter steps 24, 25*a* and 25*b*, which decrease toward the insertion end 26. Thus, the shaft-side, largest diameter step 24 serves as an insertion stop for the inside part 3. The inside contour or the inside diameters of the outside part 2 is or are correspondingly adapted to the middle and smallest diameter step 25*a* or 25*b*. The stepping of the diameter facilitates the production of the plug and socket assembly, because the inside part 3 supports a sealing ring 27 on the smallest diameter step 25*b* for sealing the plug and socket assembly 1. A further sealing ring 28 is provided on the shaft side or end face 29 of the inside part 3 remote from the insertion end 26. This further sealing ring seals the inside part 3 against the electrical device (not shown).

The inside part 3 is provided with a plurality of throughgoing bores 30 for receiving socket inserts 31, the bores corresponding in number to the associated electrical poles. Corresponding throughgoing bores 32 in the outside part 2 serve to receive plug contacts 33 that form the counter-contacts. The contacts 31, 33 can also be exchanged-for one another, in which case the outside part 2 ports the socket inserts while the inside part 3 receives the plug contacts.

FIGS. 3 and 4 illustrate the inside part 3 and the outside part 2, respectively, of the plug and socket device 1 according to the first variation, when the plug and socket assembly is detached, that is, the outside part 2 is pulled off of the inside part 3 or the inside part 3 is withdrawn from the outside part 2. FIG. 3 is a comparatively clear depiction of the stepped outside contour of the inside part 3 and the embodiment of the trough-like recess 17. In the illustrated embodiment, the plug and socket device 1 has nine poles.

FIG. 4 is a comparatively clear depiction of the embodiment of the barbs 14. The barbs 14 are provided in holes 34 of the outside part 2, and are aligned with the jacket wall 22 of the outside part 2, which limits these holes. When the sleeve 7 is retracted counter to the insertion direction E, the barbs 14 are resiliently movable in the radial direction R, so the plug and socket assembly 1 can be decoupled in this unlocked position. In other words, in this unlocked position, the outside part 2 and the inside part 3 can be separated without impediments. The withdrawing force necessary for this process depends on, among other things, the withdrawal inclination 16, while the insertion force is determined by the insertion inclination α. The transmission of the coupling forces is essentially determined by the contact surface between the cams 14*a* of the barbs 14 and the recess 17.

To achieve a particularly good transmission of the coupling and locking forces, the cam 14*a* of the barb 14 and the recess 17 in the inside part 3 are structured for maximum surface contact. For separating the outside part 2 and the inside part 3 from one another simultaneously with a low exertion of force when the plug and socket assembly 1 is unlocked, the recess 17 has a predeterminable withdrawal inclination 16 that is limited by parallel side surfaces 35 and 36 with interposed, inclined end faces. The corresponding withdrawal inclination of the barb 14 is adapted to the inclination of this end face. The width of the recess 17 is matched to the cam 14a, so the end face 37 of the cam is guided precisely.

To guard against an erroneous coupling of the outside part 2 and the inside part 3, a keying contact pin or keying contact 38 is provided in the outside part 2, and a corresponding keying socket 39 is provided in the inside part 3; these keying components must align for coupling to occur. The cross-sectional shape of the plug and socket device 1 further determines the direction during the coupling of the outside part 2 and the inside part 3. The cross-sectional shape deviates from the shape of a circle; the width of the barbs 14 extending in a straight line transversely to the axial direction A and the remaining gap widths of the hole 34 determine the deviation of the shape of the insertion opening 15 from a circle.

In the coupling of the plug and socket assembly 1, that is, the coupling of the outside part 2 and the outside part 3, the barbs 14 are pressed outward in the radial direction R, counter to the spring force of the spring shaft 14*b*, out of the holes 34 and into the outer chamber freed up by the retracted sleeve 7. The barbs 14 are deflected around the joining point of the spring shaft 14*b* to the base point of the hole 34 of the outside part 2. The barb 14 can also be deflected outward in the resting or normal position, when the sleeve 7 is retracted, and can therefore have some degree of prestressing, whereas, when the sleeve 7 is pushed forward, the barbs 14 are pressed in the radial direction R toward the inside or receiving chamber 40 of the outside part 2, and again held securely against outward movement when the sleeve 7 is pushed forward.

The preferred variation of the locking mechanism shown in FIG. 5 permits the outside part 2 to be pushed onto the inside part 3 without the sleeve 7 being retracted into the unlocked position. The barb 14', or each barb 14', has two legs. The sleeve 7, which is partially retracted in this representation and partially cut away in this region for better viewing of the two-legged barb 14', has no recessed grip. The sleeve 7 can, however, again be provided with a recessed grip 10. In this variation, the spring shaft is formed by two spring legs 14*c*, which align with the jacket wall 22 of the outside part 2, which, again, limits the legs. The cam of the barb 14' is also embodied in two parts, so the two spring legs 14*c* extending with the insertion or joining direction E in a plane transverse to the radial direction R are provided at their ends with a cam 14'*a* that is oriented in the radial direction R.

The inside part 3 has an inside contour 41 that terminates in the recess 17' for guiding the cams or latches 14'*a*. The inside contour 41, which is open in the region of the insertion end of the inside part 3, and begins there with an entry region 41*a* having parallel side surfaces, forms a track guide with the cams 14'*a* for the two-legged barb 14'. The track guide permits the outside part 2 and the inside part 3 to be coupled even if the sleeve 7 is in the locked position. The spring legs 14*c* are guided in the manner of a snap closure at the inside contour 41 of the inside part 3.

FIG. 6*a* illustrates the position of the barb 14' in this entry region 41*a* and the contact of the spring legs 14*c* in this region of the track guide. FIG. 6*b* shows this position in a cross-section along the line VIB—VIB in FIG. 6*a*. As can be seen in FIG. 6*b*, the barb 14' is guided solely with its cams 14'*a* along the inside contour 41. The cams 14'*a* are advantageously directed radially inward to the receiving chamber 40 for the inside part 3 by 90° out of the plane of the push guidance, so the inside contour 41 only forms one track guide with the cams 14'*a*.

A tapered region 41*b* of the inside contour 41 adjoins the entrance region 41*a*. The inside contour 41 tapers in the insertion direction E toward the recess 17'. FIG. 7*a* illustrates the position of the barb 14' in this tapered region 41*b*, while FIG. 7*b* is, again, the associated cross-sectional view. In the tapered region 41*b*, the spring legs 14*c* are guided toward one another until their ends meet in the adjoining narrow region 41*c*, the narrowest location of the inside contour 41. This is shown in FIGS. 8*a* and 8*b*.

FIG. 9*a* shows the position of the barb 14' in the locked state, in which the cams or latches 14'*a* are latched with a form fit in the recess 17' having a latching region 41*d*. FIG. 9*b* shows this latched state of the cams 14'*a*. The locking mechanism forms a toothed, directional locking mechanism that acts in the radial direction R, with the cams 14'*a* being embodied as pull latches or blocking latches. If the sleeve 7 is retracted into the unlocked position, the barbs 14' can be deflected radially outward when the outside part 2 and the inside part 3 are separated. This is shown in FIGS. 10*a* and 10*b*.

LIST OF REFERENCE CHARACTERS

1 Electrical plug and socket assembly
2 Outside part
3 Inside part
4 Retaining plate
5 Corner
6 Throughgoing opening
7 Sleeve
9 Shaft
10 Recessed grip
11 Guide sleeve
12 Step
13 Step/retaining collar
14 Barb
14*a* Cam/latch
14*b* Spring shaft
14*c* Spring leg
15 Insertion opening
16 Withdrawal inclination
17 Recess
18 shaft
19 Web/retaining collar
20 Annular chamber
21 Compression spring/restoring spring
22 Jacket wall/protective collar
23 Jacket web
24, 25 Diameter step
26 Insertion end
27, 28 Sealing insert
29 End face
30 Throughgoing opening
31 Socket insert
32 Throughgoing opening
33 Plug contact
34 Hole
35, 36 Side surface
37 Cam end face
38 Keying contact
38 Keying socket
40 Inside/receiving chamber
41 Inside contour
41*a* Entrance region
41*b* Tapered region
41*c* Narrow region
41*d* Latching region
A Axial direction
E Insertion direction
R Radical direction
α Insertaion inclination
β Angle

What is claimed is:

1. An electrical plug and socket assembly, comprising:

an outside part having a barb;

an inside part to be coupled to the outside part, the inside part defining a recess; and a sleeve positioned on the outside part and arranged to be axially displaced on the outside part, the sleeve having a locked position and an unlocked position, an annular chamber being defined between the sleeve and the outside part, wherein the barb extends into the recess during a coupled state, the barb being secured against a radial deflection by the sleeve in the locked position, the barb having a spring shaft with two spring legs being positioned in a first plane, each of the spring legs supporting a cam, the cams extending radially into a second plane, perpendicular and transverse to the first plane, wherein the inside part has an inside contour for guiding the cams into the recess, the outside part having a first stop for stopping the sleeve in the locked position and a second stop for stopping the sleeve in an unlocked position, the first stop being formed by a retaining collar of the outside part at an insertion opening of the recess, and the sleeve having a sleeve collar that abuts the retaining collar when the sleeve is in the locked position; and a spring positioned in the annular chamber for restoring the sleeve to the locked position.

2. The electrical plug and socket assembly according to claim 1, wherein the barb is integral with the outside part.

3. The electrical plug and socket assembly according to claim 1, wherein barb extends into the recess in an insertion direction, and wherein the inside contour tapers in the insertion direction toward the recess.

4. The electrical plug and socket assembly according to claim 1, wherein the barb is deflected radially outward when the outside part is uncoupled from the inside part and the sleeve is in the unlocked position.

5. The electrical plug and socket assembly according to claim 1, wherein the annular chamber is defined by a step in the outside part and a web formed onto an inside wall of the sleeve.

6. The electrical plug and socket assembly according to claim 1, wherein the inside part has an insertion end facing the outside part during coupling, the inside part having at least two steps that decrease toward the insertion end, one step of the at least two steps being adjacent the insertion end and supporting a sealing ring, the outside part having an inside surface that accommodates the at least two steps.

7. The electrical plug and socket assembly according to claim 1, wherein the inside part has a first plurality of axially-extending throughgoing openings for receiving contact inserts, and the outside parts has a second plurality of axially-extending throughgoing openings aligned with the first openings for receiving counter-contact inserts.

8. The electrical plug and socket assembly according to claim 1, further comprising a guide sleeve for an electrical line, the guide sleeve being coupled to and bent at an oblique angle to the outside part.

9. The electrical plug and socket assembly according to claim 1, wherein the sleeve has a circumferential recessed grip.

10. The electrical plug and socket assembly according to claim 1, wherein the assembly is multi-pole and is one of an electrical line connection and a device connection, and wherein the outside part is a coupler connection and the inside part is a portable socket outlet.

11. The electrical plug and socket assembly according to claim 10, wherein the multi-pole assembly is a nine-pole assembly.

12. The electrical plug and socket assembly according to claim 1, wherein the assembly is multi-pole and is one of an electrical line connection and a device connection, and wherein the inside part is a coupler connection and the outside part is a portable socket outlet.

13. The electrical plug and socket assembly according to claim 12, wherein the multi-pole assembly is a nine-pole assembly.

14. An electrical plug and socket assembly, comprising:

an outside part having first and second barbs and having oppositely located openings, the barbs being located in the respective openings;

an inside part to be coupled to the outside part, the inside part defining a recess;

a sleeve positioned on the outside part and arranged to be axially displaced on the outside part, the sleeve having a locked position and an unlocked position;

wherein the barbs extend into the recess during a coupled state, the barbs being secured against a radial deflection by the sleeve in the locked position, the barbs having a spring shaft with two spring legs being positioned in a first plane, each of the spring legs supporting a cam, the cams extending radially into a second plane, perpendicular and transverse to the first plane, wherein the inside part has an inside contour for guiding the cams into the recess, the outside part having a first stop for stopping the sleeve in the locked position and a second stop for stopping the sleeve in an unlocked position, and wherein the inside part and the outside part deviate from a circular shape.

15. The electrical plug and socket assembly according to claim 14, wherein the barbs are integral with the outside part.

16. The electrical plug and socket assembly according to claim 14, wherein the barbs extend into the recess in an insertion direction, and wherein the inside contour tapers in the insertion direction toward the recess.

17. The electrical plug and socket assembly according to claim 14, wherein the barbs are deflected radially outward when the outside part is uncoupled from the inside part and the sleeve is in the unlocked position.

18. The electrical plug and socket assembly according to claim 14, wherein the inside part has an insertion end facing the outside part during coupling, the inside part having at least two steps that decrease toward the insertion end, one step of the at least two steps being adjacent the insertion end and supporting a sealing ring, the outside part having an inside surface that accommodates the at least two steps.

19. The electrical plug and socket assembly according to claim 14, wherein the inside part has a first plurality of axially-extending throughgoing openings for receiving contact inserts, and the outside parts has a second plurality of axially-extending throughgoing openings aligned with the first openings for receiving counter-contact inserts.

20. The electrical plug and socket assembly according to claim 14, further comprising a guide sleeve for an electrical line, the guide sleeve being coupled to and bent at an oblique angle to the outside part.

* * * * *